US006491607B2

(12) United States Patent
Simmons et al.

(10) Patent No.: US 6,491,607 B2
(45) Date of Patent: Dec. 10, 2002

(54) APPARATUS AND METHOD FOR LOWER BACK EXERCISE

(76) Inventors: Louis J. Simmons, 1417 Demorest Rd., Columbus, OH (US) 43228; Allen K. Johnson, 11220 BE 53rd St., Kirkland, WA (US) 98033; George Johns, 211 W. Main St., Wortham, TX (US) 76693

( * ) Notice: Subject to any disclaimer, the term of this patent is extended or adjusted under 35 U.S.C. 154(b) by 0 days.

(21) Appl. No.: 09/801,040

(22) Filed: Mar. 6, 2001

(65) Prior Publication Data

US 2002/0128125 A1 Sep. 12, 2002

(51) Int. Cl.[7] ..... A63B 21/06
(52) U.S. Cl. ..... 482/93; 482/95
(58) Field of Search ..... 482/93, 97, 95, 482/137, 142, 148

(56) References Cited

U.S. PATENT DOCUMENTS

| | | | | |
|---|---|---|---|---|
| 3,120,954 A | | 2/1964 | Apostol | 272/58 |
| 3,850,430 A | | 11/1974 | Hamilton | 272/81 |
| 3,976,058 A | | 8/1976 | Tidwell | 128/25 |
| 4,292,962 A | | 10/1981 | Krause | 128/68 |
| 5,035,234 A | | 7/1991 | Forsythe | 128/25 |
| 5,066,003 A | * | 11/1991 | Jones | 272/134 |
| 5,356,359 A | * | 10/1994 | Simmons | 482/97 |

* cited by examiner

*Primary Examiner*—Michael A. Brown
*Assistant Examiner*—Lori Baker Amerson
(74) *Attorney, Agent, or Firm*—John A. Thomas

(57) ABSTRACT

A lower back exercise and apparatus for performing a lower back exercise. The apparatus has a vertical pendulum suspended under the person exercising, who lies prone above the pendulum. The person's legs are retained in a resistance transfer apparatus that pivotably connects to the pendulum. Weights may be added to the pendulum The exercise raises the person's legs from the vertical to the horizontal. The exercise then lowers the legs from the horizontal through and past the vertical rest position, in a total motion substantially greater than 90 degrees, using the same muscle groups to push the legs past the vertical rest position. The body support platform may be adjusted to various angles with respect to the horizontal.

14 Claims, 6 Drawing Sheets

APPARATUS AND METHOD FOR LOWER BACK EXERCISE

CO-PENDING APPLICATION

Applicant Louis J. Simmons is one of the inventors in, and the owner of, co-pending application Ser. No. 09/713,930, filed Nov. 15, 2000.

FIELD OF THE INVENTION

The invention relates to an improved apparatus and method for lower back exercise and an apparatus for exercising the lower back.

BACKGROUND OF THE INVENTION

Back muscle and cartilage injuries, especially in the lower lumbar region of the back are relatively common. Such injuries are especially common in individuals who, for one reason or another, have failed to maintain the conditioning and tone of the muscles that support the lower back. These muscles, the spinal erectors and hip flexor must be maintained in reasonable condition if such muscle and cartilage injuries are to be protected against.

Additionally, once injury has occurred, healing can be promoted by increasing the flow of blood to the injured muscles and the areas surrounding the injury. Unfortunately, the number and density of blood vessels in the lower back area is relatively low. However, exercise is believed by many to stimulate increased blood flow. A draw back to most forms of exercise is the risk or tendency of hyperextension of the already injured muscles thereby aggravating the injury rather than promoting healing of the muscles, cartilage and surrounding tissues.

There have been a number of attempts to exercise the back and other body parts to increase muscle tone and stimulate the flow of blood to muscles and tissues: U.S. Pat. No. 5,035,234 to Forsythe discloses a back exercise apparatus that includes one section in which the user lies on his side, and a second section attached to the users legs which the user rotates about a vertical axis.

U.S. Pat. No. 5,094,445 to Winkelvoss describes an exercise machine that includes a horizontal torso support from which the legs hang vertically downward. The user then lifts his legs to the horizontal to exercise the lower back.

U.S. Pat. No. 3,120,954 to Apostol discloses an exercise apparatus including a table having a weight bar pendulum attached to one end.

U.S. Pat. No. 4,292,962 to Krause describes a posture treatment apparatus that includes a platform for supporting the users torso in a perpendicular relationship to his legs.

However, none of the previous attempts have met the exercise needs of individuals who have already sustained lower back injuries or whose lower back areas are too out-of-condition to be able to withstand rigorous exercise. In order for exercise to be of value, it must progressively increase in intensity. A common method of increasing the intensity of an exercise is through the use of increased resistance from static weight additions. However, adding weight to an exercise can increase the hyperextension of lower back muscles. Therefore, weight training is not generally recommended for those suffering from lower back muscle, tissue and cartilage injuries.

There is a need for a method of exercise and an exercise apparatus that avoids hyperextension of lower back muscles while providing for conditioning and muscle tone, and which can increase local blood circulation to injured muscles and tissues in the lower back. There is also a need for an exercise that can permit progressive intensity of the work out to strengthen lower back muscles, tissues and provide increased blood flow to those areas. U.S. Pat. No. 5,356,359, to Applicant Louis J. Simmons addresses these needs. The present application is an improvement over the apparatus disclosed in U.S. Pat. No. 5,356,359, as well as the apparatus disclosed in Applicant's pending U.S. patent application Ser. No. 09/713,930.

SUMMARY OF THE INVENTION

The instant invention is a method for exercising the lower back and upper legs in which the muscles of the lower back contracted to lift the legs to a horizontal position for a person lying face down, anterior side down, on an apparatus designed to implement the exercise. The apparatus provides for the pivoting interconnection and cooperation of the legs with a static weight retaining portion of the apparatus. Because the muscles are contracted only and because the muscles only accomplish the task of lifting the legs against the static resistance of the weights, no hyperextension of the muscles of the lower back occurs, especially the spinal erector and hip flexor muscles of the lower back. The pivoting interconnection permits use of the apparatus with optimal benefit for persons of all leg length and body size. The adjustable static weight system further provides a work out level commensurate with the starting strength of each individual and permits weight adjustment to allow for progressively increasing the intensity of the work out as strength increases.

A primary aspect of the present invention is the provision for a method of exercising lower back muscles, even in an individual who has suffered injury to those muscles and surrounding tissue under which the muscles can be vigorously exercised without the risk of hyperextension and subsequent re-injury or aggravation of existing injury.

The first preferred embodiment is an apparatus for lower back exercise comprising a support structure that further comprises a body support platform supported by the support structure. The body support platform may be pivotable with respect to the horizontal to allow the exercise to proceed at different levels of intensity or to stress different muscle groups in the lower back.

A pendulum, having an upper portion and a lower portion, is pivotably connected to the support structure below the body support platform. The upper portion of the pendulum has a bearing; the pendulum being connected to the support structure with the bearing.

The pendulum further comprises a frame connected to the lower portion of the pendulum and one or more weights removably connected to the frame. A sleeve slideably engages the pendulum and has an adjustable lock for adjustably fixing the sleeve to the pendulum. A resistance transfer apparatus is pivotably connected to the sleeve by means of a mounting assembly. The mounting assembly comprises a fork and a pin for pivotably connecting to the sleeve at a connecting pivot on the sleeve.

The resistance transfer apparatus pivots in a plane substantially parallel to that of the pendulum while engaging the lower legs of a person exercising; the resistance transfer apparatus further comprises a central bar connected to the mounting assembly and at least one pair of resistance rods connected to the central bar and disposed perpendicular to the central bar on opposite sides thereof for engaging the legs of a person exercising. The resistance transfer apparatus has one or more pads with a circular cross-section and concentric holes sized so that the pads each receives one of the resistance rods.

We also disclose a method using the invention for exercising the lower back and upper legs, comprising the steps of:

(a) disposing a person anterior side down on a body support platform so that the stomach and chest areas are supported and maintained above the ground and such that the legs are not supported by the platform but hang freely and vertically down from the edge of the platform;

(b) maintaining the body support platform above the ground with a support structure, and wherein the support structure retains the body support platform at least high enough that the legs and feet of the person are maintained above the ground;

(c) providing a pendulum which is pivotably connected to the support structure and providing the other end of the pendulum with a mounting assembly;

(d) providing a resistance transfer apparatus connected to the pendulum by means of the mounting assembly; the resistance transfer apparatus having resistance rods;

(e) placing the legs of the person against the resistance rods so that the resistance transfer apparatus connects the lower legs of the person to the lower end of the pendulum;

(f) lifting the legs to a horizontal position against the weight resistance of the pendulum by means of the resistance transfer apparatus wherein the force of lifting is provided by the contraction of the gluteus maximus, and the erector and flexor muscles of the lower back;

(g) lowering the legs through the vertical rest position and using those same muscle groups to push the legs past the vertical in a total motion substantially greater than 90 degrees. repeating the lifting and lowering steps to form an exercise regimen.

BRIEF DESCRIPTION OF THE DRAWINGS

The best mode contemplated in carrying out this invention is illustrated and better understood by reference to the following detailed description when considered in conjunction with the accompanying drawings, in which:

FIG. 9 is side elevations of the second preferred embodiment showing the adjustable table.

DETAILED DESCRIPTION OF THE PREFERRED EMBODIMENTS

First Preferred Embodiment

Figure 1:
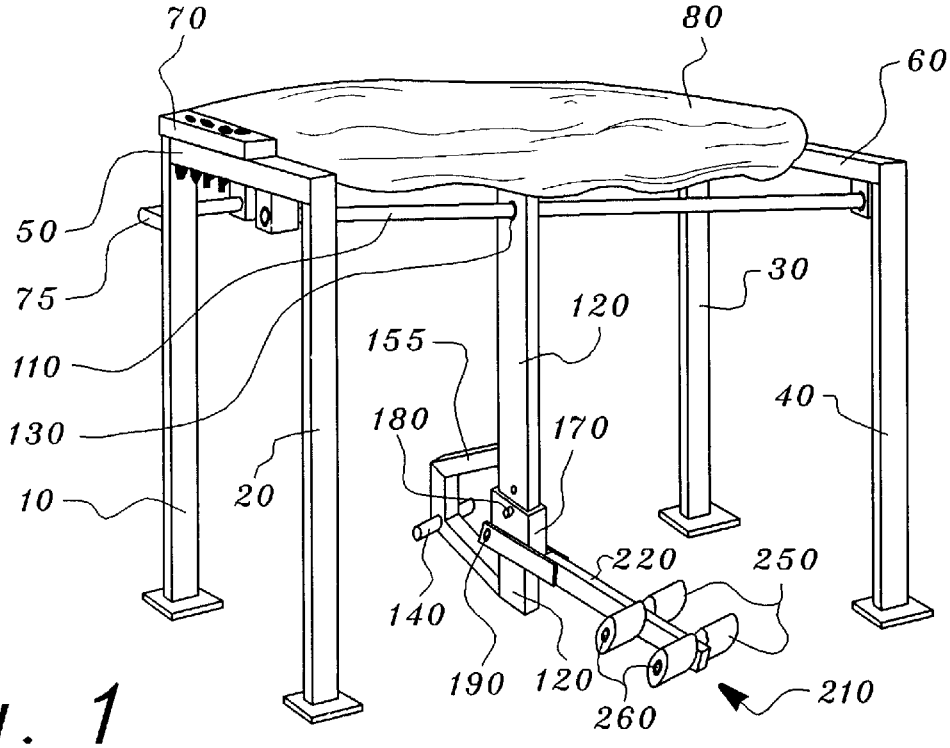
FIG. 1 is a perspective view of the first preferred embodiment of the invention, omitting the resistance transfer apparatus.
Figure 2:
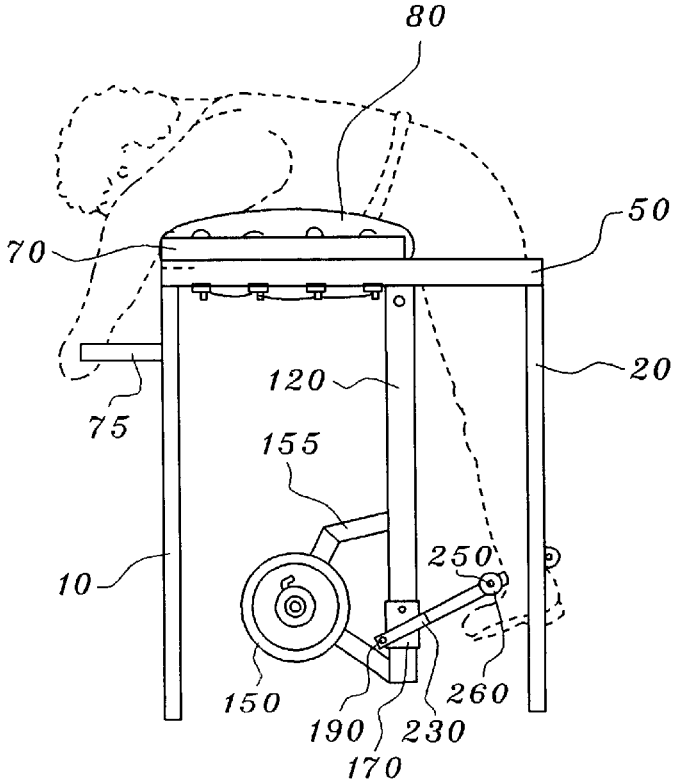
FIG. 2 is a side elevation of an apparatus according to the present invention with a person shown in the proper position to start the exercise of the invention.

The first preferred embodiment of the invention is illustrated by FIGS. 1–5. Support legs (10), (20), (30), and (40) are connected by support cross arms (50) and (60), and body support platform (70) to form a support structure. The support structure could be constructed without the inclusion of the body support platform, and a non-structural body support platform then horizontally disposed on the support structure. The structural legs and arms (10)–(60) should preferably be made of structural steel sections to provide a very rigid support structure. Conventional bracing may be added, if needed. Movement of the support structure during the exercise is both dangerous and can cause unneeded anxiety in the person who is performing the exercise. It is preferred that a padding (80) provided on the upper surface of the body support platform for the comfort of the person engaging in the exercise method of the instant invention.

A pivot bar (110), which may be located at any location below the body support platform, rotatably retains the pendulum (120). However, for optimal implementation of the exercise method the pivot bar (110) should be located at a point below the location of the waist of the person using the apparatus and at a vertical position near the body support platform. In this way, the length of pendulum (120) can be maximized.

Pendulum (120) is rotatably retained on the pivot bar (110) by one or more bearings (130), which may be a mere hole in pendulum (120), or one or more bearings (130) fitted to the pivot bar (110). The bearing or bearings (130) may be equivalently mounted on support cross arms (50) and (60), or elsewhere on the supporting structure to thereby rotatably retain the pivot bar (110). In this case, the pendulum (120) would be fixed to the pivot bar (110). The pivot bar (110) may be suspended from the body support platform (70), in which case the pivot bar (110) need only be long enough to adequately engage the pendulum (120) by means of the bearing or bearings (130). In any embodiment, pendulum (120) is then freely pivotable about the pivot bar (110) from one end of the pendulum (120) as shown, in a substantially vertical plane.

Figure 5:
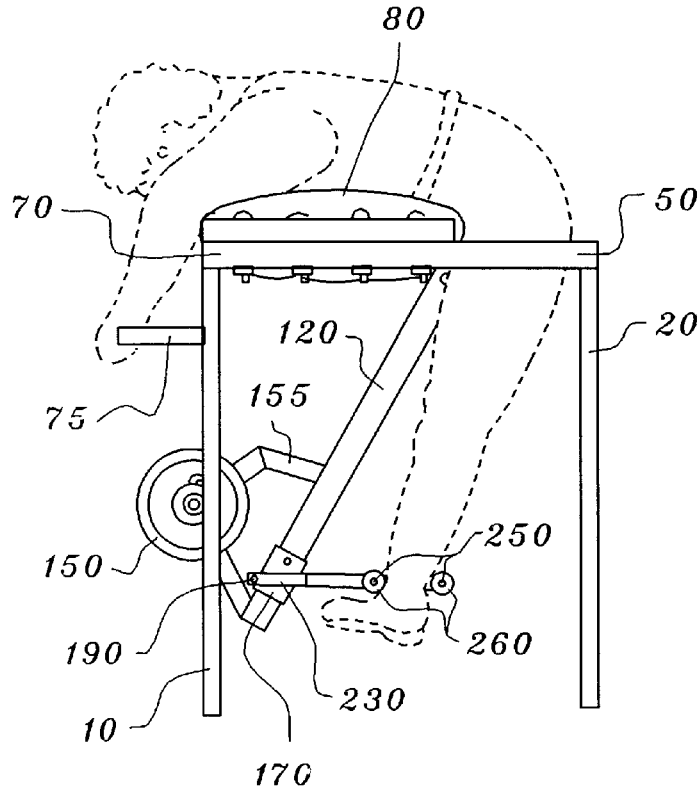
FIG. 5 is a side elevation of an apparatus according to the present invention with a person shown performing the recovery action of the exercise method of the invention.
Figure 6:
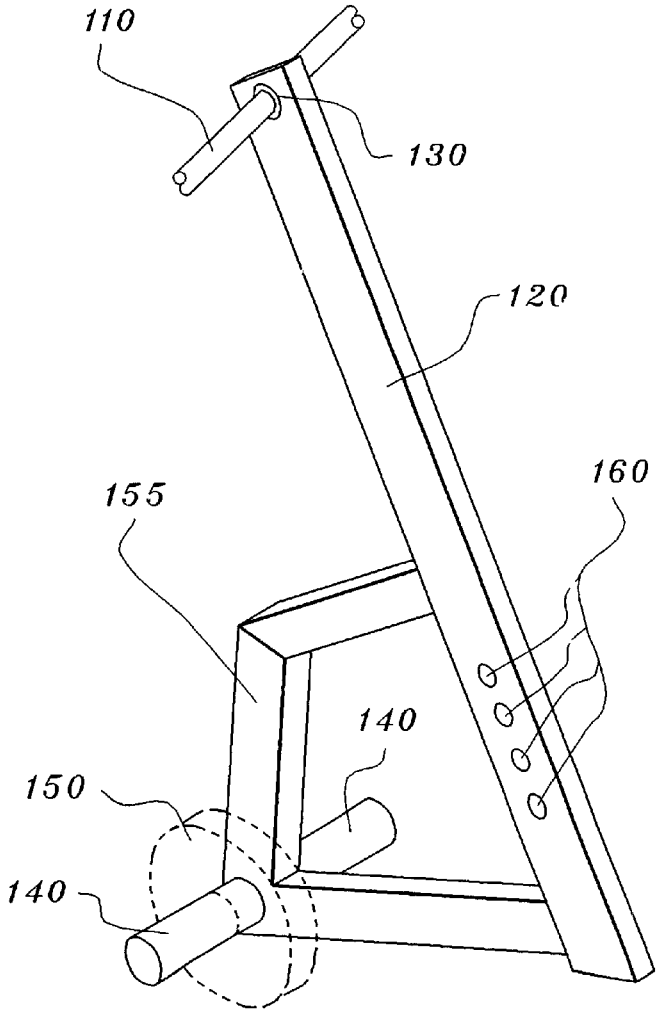
FIG. 6 is a perspective view of the pendulum of the apparatus of the first preferred embodiment.

Located at the other end of the pendulum (120) is a weight bar (140) which acts as a weight against which the exercise is performed. Additional weights (150) can be added to weight bar (140) to permit increasing intensity to the exercise. In the first preferred embodiment, the weight bar (140) is mounted on a frame (155), which frame (155) is attached to the pendulum (120) as shown in FIGS. 5 and 6. By so positioning the weight bar, the person exercising will be forced to expend more energy in moving the pendulum (120) forward (as viewed by the person exercising) from the vertical, because the weight bar, the person exercising will be forced to expend more energy in moving the pendulum (120) forward (as viewed by the person exercising) from the vertical, because the weight must be raised to a height above the tangent to the arc defined by the swing of the pendulum (120) than would be the case if the weight bar (140) were positioned on the centerline of the pendulum (120). This is the position of the pendulum (120) in FIG. 5.

Figure 7:
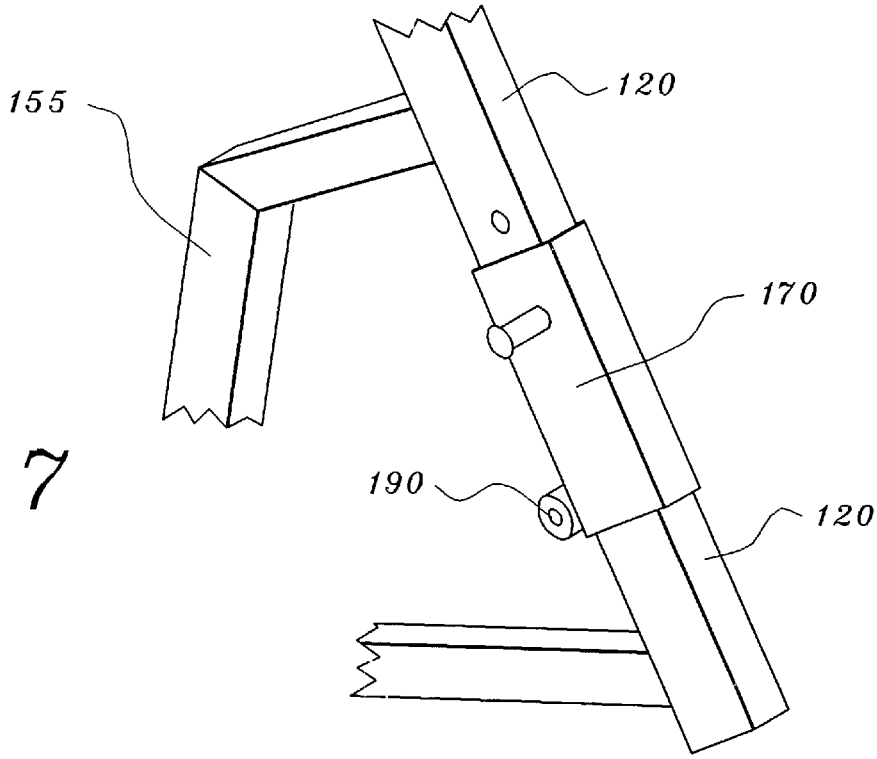
FIG. 7 is a partial perspective view of the sleeve and pivot connection of the pendulum to the resistance transfer apparatus.
Figure 8:
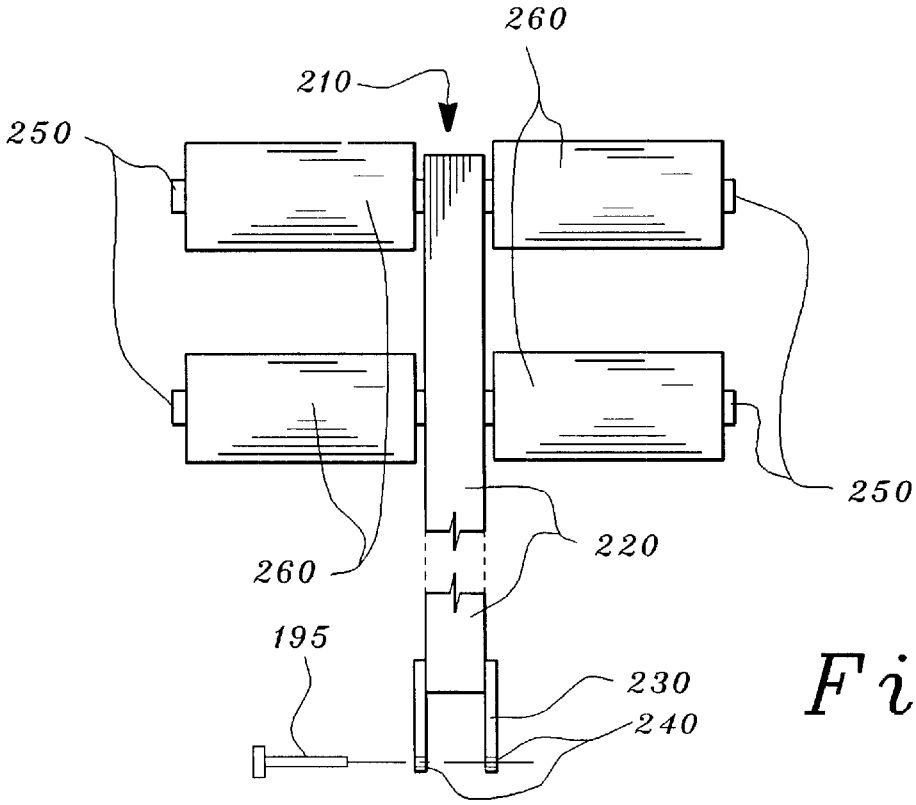
FIG. 8 is a plan view of the resistance transfer apparatus of the first preferred embodiment.

A resistance transfer apparatus (210) is rotatably attached to the pendulum (120) at a connector (190). FIG. 8 shows the resistance transfer apparatus (210) and FIGS. 6 and 7 show the way it is connected to the pendulum (120). The resistance transfer apparatus (210) of the first preferred embodiment has a central bar (220) and a mounting assembly, which, in the first preferred embodiment, is a fork (230). The mounting fork (230) has holes (240) passing thorough the arms of the fork (230) to receive a pivot pin (195) as described below.

In the first preferred embodiment, the pendulum (120) is engaged in sliding fit by a sleeve (170). The sleeve (170) has a cross-section congruent with that of the pendulum (120) and sized to slideably fit over the pendulum (120) inside the area defined by the members of the frame (155) and the pendulum (120). The pendulum (120) has two or more adjustment holes (160) which are engaged by an adjustment pin (180) attached to the sleeve (170), forming an adjustable lock. In this way, the position of the resistance transfer apparatus (210) can be adjusted along the length of the pendulum (120) to accommodate different leg lengths of users. A connector (190) is also attached to the sleeve (170), as shown in FIG. 7. The connector (190) is preferably a tube through which a pivot pin (195) can be passed, so that the pin (195) also passes through the holes (240) in the arms of the fork (230) and thus pivotably retains the resistance transfer apparatus (210) on the sleeve (170). The pin (195) may alternatively be a bolt, screw, or cotter pin.

The resistance transfer apparatus (210), as shown in FIG. 8 preferably has two or more pads (260), which pads (260) are preferably rotatably mounted on resistance bars (250) extending from the central bar (220) of the resistance transfer apparatus (210). The resistance transfer apparatus (210) thus comfortably retains the person's ankles as the exercise is executed. The resistance transfer apparatus (210) may retain the person's legs anywhere along their length, but the optimum position is at the ankles, as shown.

The resistance transfer apparatus (210) and its rotatable connection to the pendulum (120) permits an unrestrained arc of the legs as they move up to the horizontal and back past the vertical during the exercise. This also allows the person to mount the exercise apparatus without the cumbersome situation of having weights attached to the ankles or feet. The static weight of pendulum (120), bar (140) and weights (150), if any, do not come into play or weight the ankles until the exercise is begun with the pendulum vertical.

Second Preferred Embodiment

Figure 9A:
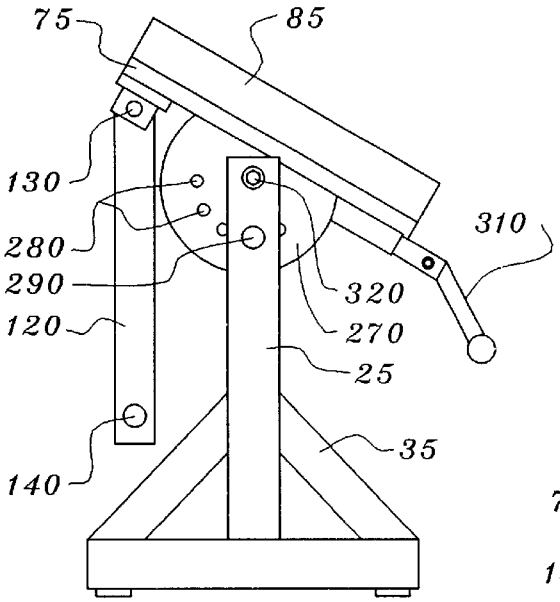
FIG. 9*a* shows the table tilted to raise the pendulum.
Figure 9B:
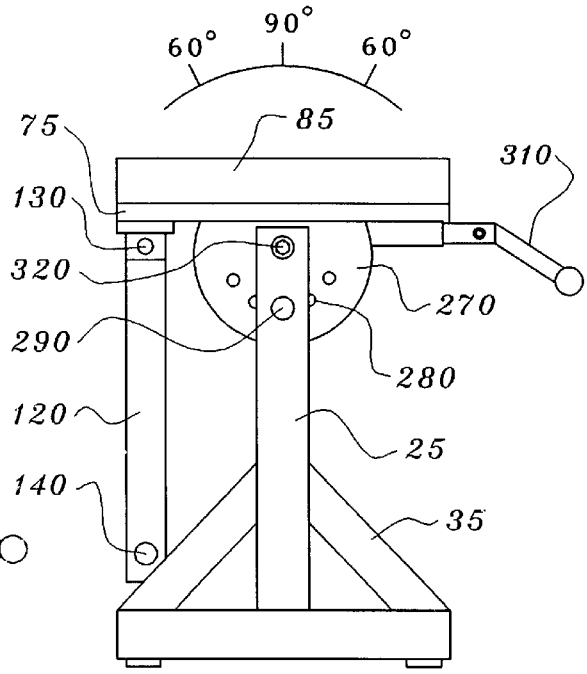
FIG. 9*b* shows the table level.
Figure 9C:
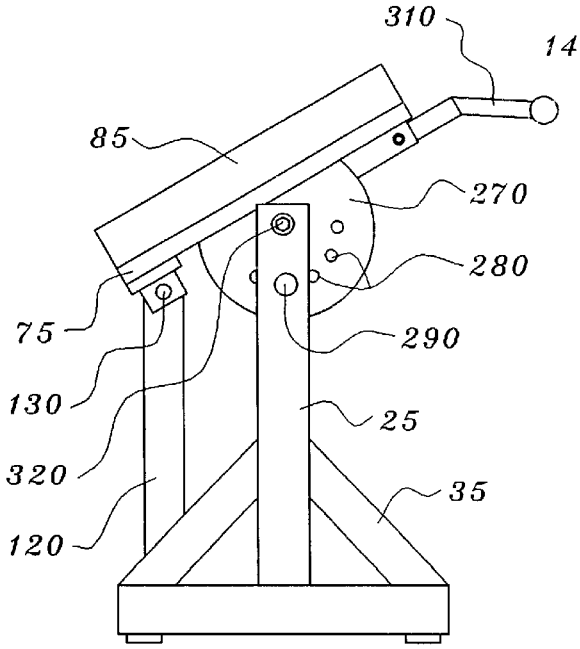
FIG. 9*c* shows the table tiled to lower the pendulum.
Figure 10:
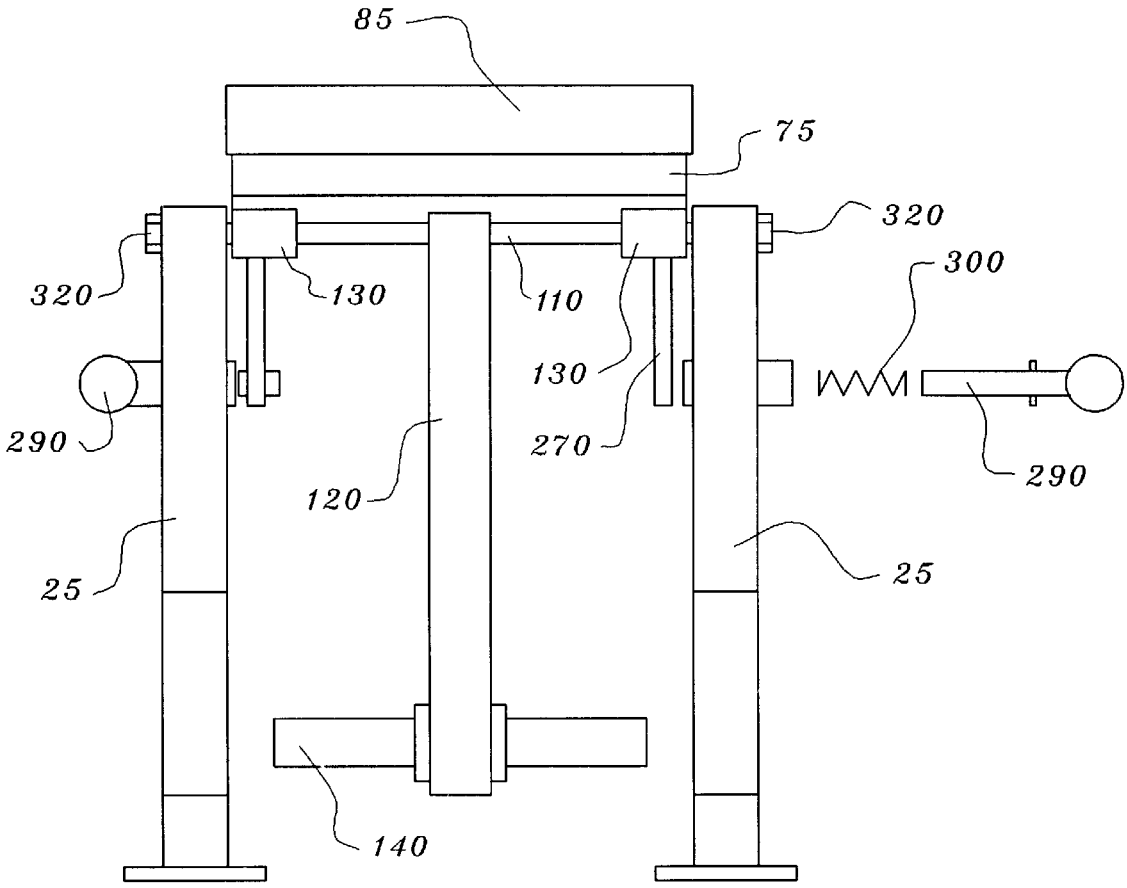
FIG. 10 is a plan view of the second preferred embodiment.

In the second preferred embodiment, the support platform (70) is made adjustable. As shown in FIGS. 9 and 10, the second preferred embodiment has an adjustable support platform (75), also having a padding (85). The adjustable support platform (75) is disposed to rotate about pivot points (320). The adjustable support platform is locked into a selected angle with respect to the horizontal by means of at least one adjustment flange (270). The adjustment flange has locking holes (280) which receive a locking pin (290). In the second preferred embodiment, the locking pin (290) is held in an engaged position by a spring (300). The locking pin (290) can thus be pulled outwardly allowing movement of the adjustment flange (270) and therefore the adjustable support platform (75). When the locking pin (290) is released it will return to engagement with the selected locking hole (280). The support platform (75) preferably has a handle (310).

The second preferred embodiment may be supported as described for the first preferred embodiment, or supported by support members (25) and (35) as shown in FIGS. 9 and 10.

The pendulum (120) shown in the first preferred embodiment may also be used for the second preferred embodiment. FIGS. 9 and 10 show the pendulum (120) affixed to a pivot bar (110) and held by bearings (130) fitted to the adjustable support platform (75). The bearings (130) may of course be ball bearings, or simply bushings. A weight bar (140) is located at the end of the pendulum (120) to support additional weights (150).

The reader will note that the weight bar (140) may be attached to a frame (155), exactly as described for the first preferred embodiment. And, a resistance transfer apparatus (210) may be rotatably attached to the pendulum (120), also, as shown above. In this case the second preferred embodiment will function just as does the first preferred embodiment, except that the angle of the support platform (75) may be adjusted to suit the exercise intensity desired.

Turning to FIGS. 2, 3, 4, and 5, the entire range of the exercise is illustrated. At FIG. 2, the person performing the exercise is shown in the proper position (face down or equivalently, anterior side down), using the first preferred embodiment of the invention. Although this description uses the first preferred embodiment, the second preferred embodiment, having an adjustable support platform (75) could be used equally well. The torso to the waist is fully supported by body support platform (70). For comfort and as an aid to mounting the apparatus handles (77) attached to the support structure may be provided. Only one handle (77) is shown in the drawings, but in practice, two handles would be used, for grasping by both hands. The person's lower legs are shown passing through the resistance transfer apparatus (210) and weights (150) are shown in place on bar (140). Preferably, the exercise is performed with the ankles passing through the resistance transfer apparatus (210). The pendulum is at rest in the vertical position straight below the waist of the person.

Figure 3:
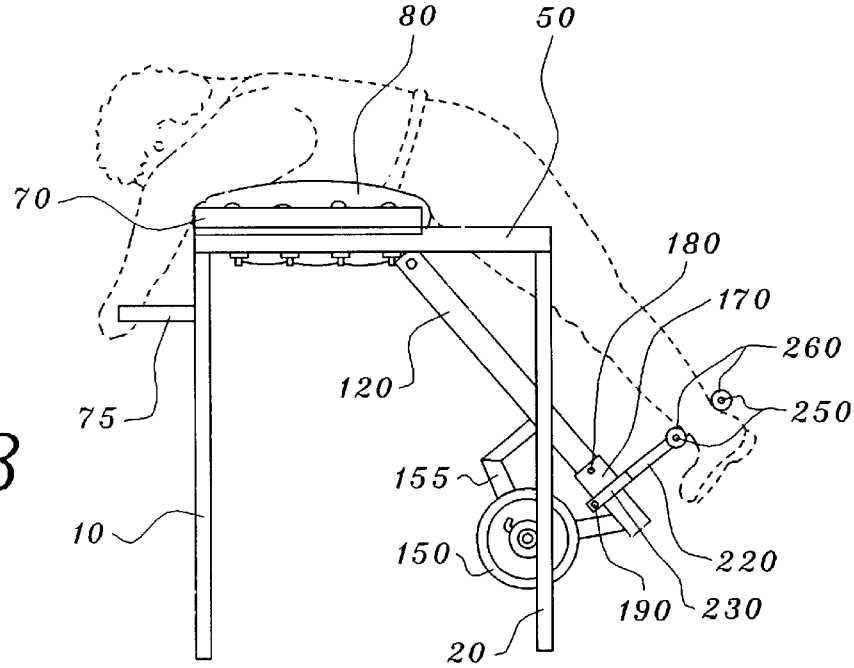
FIG. 3 is a side elevation of an apparatus according to the present invention with a person shown performing the primary action of the exercise method of the invention.

The exercise begins by the person contracting the muscles of the lower back (i.e., spinal erectors and hip flexors) and the gluteus maximus. The legs working against the variable combined weight of pendulum (120), bar (140) and weights (150) are moved through the intermediate position shown in FIG. 2 to the horizontal position as shown in FIG. 3.

The resistance transfer apparatus (210) pivots about the connector (190) on the sleeve (170) attached to the pendulum (120) so as to keep the pads (260) engaged with the person's legs, preferably at the ankles, as shown in FIGS. 2 through 5.

Figure 4:
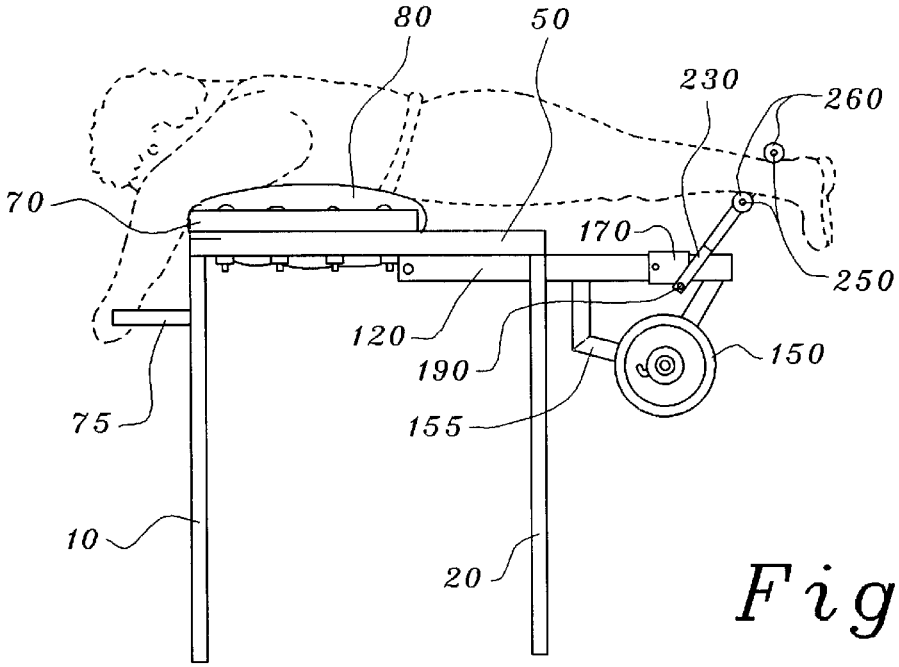
FIG. 4 is a side elevation of an apparatus according to the present invention with a person shown in the maximum extension of the exercise method.

The person then lowers the legs, not by simply relaxing the muscles, but by lowering the legs using all the muscle groups of the upper legs and lower back. The legs are fully lowered to at least the vertical and then are pushed by muscle action forward past the vertical as shown in FIG. 5. Thus, the total range of motion of the legs is greater than 90 degrees. After the person has pushed the legs as far past the vertical as he can, the exercise begins again by contracting the muscles and pushing the legs back to the horizontal (FIG. 4). The exercise is then repeated the number of times desired by the person exercising.

The exercise is best performed as a smooth continuous action through the iterations. At all points in the exercise, the legs and correspondingly the affected muscles only push and are never pulled from one station to the next. The result is that hyperextension of muscles is avoided and the injured muscles of the lower back are permitted to receive an increase flow of blood. Additionally, in a person with an otherwise healthy lower back, the exercise builds up those lower back muscles thus avoiding future injury.

An additional means may be provided within the apparatus for assuring the exerciser can only push with the target muscle groups is the addition of a counter weighted pulley and cable system (not shown in the drawings) that cooperates with the resistance transfer apparatus not only to provide resistance to the initial lifting of the legs to the horizontal position, but also provides static weight resistance to returning the legs to and past the vertical starting position in accordance with the exercise as described above.

Increasing lower back strength is also critical to power lifting. The most common injuries to power lifters are those of the lower back. However, by regularly utilizing the exercise of this invention, persons who lift very heavy weights for sport or in competition, also known as power lifters, can train to greater weight levels while avoiding lower back injuries which are not only counter productive to a proper training program due to lost training time, but also could lead to permanent lower back injuries that are also common among power lifters.

It will be apparent from the above description that this invention provides for a method of exercise and an exercise apparatus for implementing that exercise, in which the muscles of the lower back can be safely exercised and allow for the increased circulation of blood attendant to the proper exercising of all muscles. This increased circulation of blood also promotes healing of damaged or injured muscles and neighboring tissue in the lower back. The exercise further provides for the exercise of these muscles without the danger of hyperextension of the muscles during the exercise.

This invention may be embodied in other specific forms without departing from the spirit or essential characteristics thereof. Present embodiments are therefore considered in all respects as illustrative and not restrictive, the scope of the invention being indicated by the appended claims rather than the foregoing description and drawings, and all changes that come within the meaning and range and equivalency of the claims are therefore intended to be embraced therein.

We claim:

1. An apparatus for lower back exercise, the apparatus comprising:

a. a support structure, the support structure further comprising a body support platform supported by the support structure;

b. a pendulum, the pendulum having an upper portion and a lower portion; the upper portion of the pendulum pivotably connected to the support structure below the body support platform;

c. a resistance transfer apparatus pivotably connected to the lower portion of the pendulum; the resistance transfer apparatus pivoting in a plane substantially parallel to the plane of the pendulum while engaging the legs of a person exercising; and, d. the lower portion of the pendulum having a sleeve slideably engaging the pendulum; the sleeve pivotably connected to the resistance transfer apparatus.

2. The apparatus for lower back exercise of claim 1 above further comprising an adjustable lock for adjustably fixing the sleeve to the pendulum.

3. The apparatus for lower back exercise of claim 1 above where the resistance transfer apparatus further comprises:

a. a mounting assembly for pivotably connecting to the lower portion of the pendulum;

b. a central bar connected to the mounting assembly; and, c. at least one pair of resistance rods connected to the central bar and disposed perpendicular to the long axis of the central bar on opposite sides thereof, for engaging the legs of a person exercising.

4. The resistance transfer apparatus of claim 3 above, where the mounting assembly comprises a fork and pin.

5. The resistance transfer apparatus of claim 3 above, further comprising one or more pads connected to the resistance rods.

6. The resistance transfer apparatus of claim 3 above, where the pads have a circular cross-section and concentric holes; the holes sized so that each of the pads receives one of the resistance rods.

7. An apparatus for lower back exercise, the apparatus comprising:

a. a support structure, the support structure further comprising a body support platform supported by the support structure;

b. a pendulum, the pendulum having an upper portion and a lower portion; the upper portion of the pendulum pivotably connected to the support structure below the body support platform;

c. a resistance transfer apparatus pivotably connected to the lower portion of the pendulum; the resistance transfer apparatus pivoting in a plane substantially parallel to the plane of the pendulum while engaging the legs of a person exercising;

d. the body support platform pivotably connected to the support structure;

e. at least one adjustment flange connected to the body support platform, the adjustment flange having at least two holes for receiving a locking pin; and, f. a locking pin for engaging the holes in the adjustment flange, whereby the body support platform is removably locked into a pre-determined angle with respect to the horizontal.

8. An apparatus for lower back exercise comprising:

a. a pendulum having an upper and a lower portion, the pendulum pivotably disposed below a person exercising;

b. a resistance transfer apparatus pivotably connected to the lower portion of the pendulum; the resistance transfer apparatus further comprising:

(1) a mounting assembly for pivotably connecting to the lower portion of the pendulum;

(2) a central bar connected to the mounting assembly; and, (3) at least one pair of resistance rods connected to the central bar and disposed perpendicular to the long axis of the central bar on opposite sides thereof, for engaging the legs of a person exercising; and, c. the lower portion of the pendulum having a sleeve slideably engaging the pendulum; the sleeve pivotably connected to the resistance transfer apparatus by means of a mounting assembly.

9. The apparatus for lower back exercise of claim 8 above, where the position of the sleeve on the pendulum may be adjustably fixed.

10. The apparatus for lower back exercise of claim 8 above, where the mounting assembly comprises a fork and a pin.

11. An apparatus for lower back exercise comprising:

a. a support structure, the support structure further comprising a body support platform supported by the support structure;

b. a pendulum, the pendulum having an upper portion and a lower portion, the upper portion of the pendulum having a bearing; the pendulum being pivotably connected to the support structure with the bearing, below the body support platform; the pendulum further comprising:

(1) a frame connected to the lower portion of the pendulum;

(2) one or more weights removably connected to the frame;

(3) a sleeve slideably engaging the pendulum; and, (4) an adjustable lock for adjustably fixing the sleeve to the pendulum; and, c. a resistance transfer apparatus pivotably connected to the sleeve by means of a mounting assembly; the mounting assembly comprising a fork and a pin for pivotably connecting to the sleeve; the resistance transfer apparatus pivoting in a plane substantially parallel to that of the pendulum while engaging the lower legs of a person exercising; the resistance transfer apparatus further comprising:

(1) a central bar connected to the mounting assembly; and, (2) at least one pair of resistance rods connected to the central bar and disposed perpendicular to the central bar on opposite sides thereof, for engaging the legs of a person exercising; and, (3) one or more pads; the pads having a circular cross-section and concentric holes; the holes sized so that the pads each receives one of the resistance rods.

12. An apparatus for lower back exercise comprising:

a. a support structure, the support structure further comprising a body support platform supported by the support structure;

b. the body support platform pivotably connected to the support structure;

c. at least one adjustment flange connected to the body support platform, the adjustment flange having at least two holes for receiving a locking pin;

d. a locking pin for engaging a hole in the adjustment flange, whereby the body support platform is removably locked into a pre-determined angle with respect to the horizontal;

e. a pendulum, the pendulum having an upper portion and a lower portion, the upper portion of the pendulum having a bearing; the pendulum being pivotably connected to the support structure with the bearing, below the body support platform; the pendulum further comprising:

(1) a frame connected to the lower portion of the pendulum;

(2) one or more weights removably connected to the frame;

(3) a sleeve slideably engaging the pendulum; and, (4) an adjustable lock for adjustably fixing the sleeve to the pendulum; and, f. a resistance transfer apparatus pivotably connected to the sleeve by means of a mounting assembly; the mounting assembly comprising a fork and a pin for pivotably connecting to the sleeve; the resistance transfer apparatus pivoting in a plane substantially parallel to that of the pendulum while engaging the lower legs of a person exercising; the resistance transfer apparatus further comprising:

(1) a central bar connected to the mounting assembly; and, (2) at least one pair of resistance rods connected to the central bar and disposed perpendicular to the central bar on opposite sides thereof, for engaging the legs of a person exercising; and, (3) one or more pads; the pads having a circular cross-section and concentric holes; the holes sized so that the pads each receives one of the resistance rods.

13. A method for exercising the lower back and upper legs comprising the steps of:

(a) disposing a person anterior side down on a body support platform so that the stomach and chest areas are supported and maintained above the ground and such that the legs are not supported by the platform but hang freely and vertically down from the edge of the platform;

(b) maintaining the body support platform above the ground with a support structure, and wherein the support structure retains the body support platform at least high enough that the legs and feet of the person are maintained above the ground;

(c) adjusting the angle of the body support platform with respect to the horizontal by pivoting the body support platform to a pre-determined angle and locking the body support platform in that position by means of an adjustment flange and locking pin;

(d) providing a pendulum which is pivotably connected to the support structure and providing the other end of the pendulum with a mounting assembly;

(e) providing a resistance transfer apparatus connected to the pendulum by means of the mounting assembly; the resistance transfer apparatus having resistance rods;

(f) placing the legs of the person against the resistance rods so that the resistance transfer apparatus connects the lower legs of the person to the lower end of the pendulum;

(g) lifting the legs to a horizontal position against the weight resistance of the pendulum by means of the resistance transfer apparatus wherein the force of lifting is provided by the contraction of the gluteus maximus, and the erector and flexor muscles of the lower back;

(h) lowering the legs through the vertical rest position and using those same muscle groups to push the legs past the vertical in a total motion substantially greater than 90 degrees repeating the lifting and lowering steps to form an exercise regimen.

14. A method according to claim 13 further comprising the step of providing variable weight amounts to be retained on the pendulum.

* * * * *